US011871797B2

(12) United States Patent
Lee et al.

(10) Patent No.: US 11,871,797 B2
(45) Date of Patent: Jan. 16, 2024

(54) AEROSOL GENERATING DEVICE AND OPERATING METHOD THEREFOR

(71) Applicant: KT&G CORPORATION, Daejeon (KR)

(72) Inventors: Jae Min Lee, Siheung-si (KR); Sang Kyu Park, Hwaseong-si (KR)

(73) Assignee: KT&G CORPORATION, Daejeon (KR)

( * ) Notice: Subject to any disclaimer, the term of this patent is extended or adjusted under 35 U.S.C. 154(b) by 653 days.

(21) Appl. No.: 17/057,899

(22) PCT Filed: May 20, 2020

(86) PCT No.: PCT/KR2020/006583

§ 371 (c)(1),
(2) Date: Nov. 23, 2020

(87) PCT Pub. No.: WO2020/256291

PCT Pub. Date: Dec. 24, 2020

(65) Prior Publication Data

US 2022/0132936 A1 May 5, 2022

(30) Foreign Application Priority Data

Jun. 18, 2019 (KR) ..... 10-2019-0072425

(51) Int. Cl.
*A24F 40/00* (2020.01)
*A24F 40/57* (2020.01)
*A24F 40/53* (2020.01)

(52) U.S. Cl.
CPC ..... *A24F 40/57* (2020.01); *A24F 40/53* (2020.01)

(58) Field of Classification Search
CPC ..... A24F 40/57; A24F 40/51
See application file for complete search history.

(56) References Cited

U.S. PATENT DOCUMENTS 10,039,323 B2 * 8/2018 Schuler ..... A24F 40/42
10,716,329 B2 7/2020 Matsumoto et al.
(Continued)

FOREIGN PATENT DOCUMENTS

EP 2253233 A1 11/2010
EP 3369328 A2 9/2018
(Continued)

OTHER PUBLICATIONS

Notification of Reason for Refusal dated Jan. 6, 2021 from the Korean Intellectual Property Office in KR Application No. 10-2019-0072425.
(Continued)

*Primary Examiner* — Phuong Chi Thi Nguyen
(74) *Attorney, Agent, or Firm* — Sughrue Mion, PLLC

(57) ABSTRACT

Provided is an aerosol generating device including: a heater heating an aerosol generating material by power supplied; a battery storing power to be supplied to the heater; and a controller controlling power supply to the heater and power supply to the battery, wherein, the controller monitors a heating state of the heater when the aerosol generating device is electrically connected to an external power supply source; performs heating of the heater without charging of the battery by the external power supply source when the monitored heating state is determined to be a rapid heating state; and controls power supply to the heater and power supply to the battery to perform charging of the battery and heating of the heater together by the external power supply source when the monitored heating state is determined not to be the rapid heating state.

15 Claims, 12 Drawing Sheets

(56) References Cited

U.S. PATENT DOCUMENTS

| | | | | |
|---|---|---|---|---|
| 11,622,582 | B2 * | 4/2023 | Lim | A24F 40/51 131/273 |
| 11,700,884 | B2 * | 7/2023 | An | A24F 40/53 131/329 |
| 2014/0348495 | A1 | 11/2014 | Greim | |
| 2015/0020831 | A1 | 1/2015 | Weigensberg et al. | |
| 2015/0201676 | A1 | 7/2015 | Shin | |
| 2019/0380390 | A1 | 12/2019 | Jeong et al. | |
| 2019/0387806 | A1 | 12/2019 | Nakano et al. | |

FOREIGN PATENT DOCUMENTS

| | | | |
|---|---|---|---|
| KR | 10-2014-0013653 | A | 2/2014 |
| KR | 10-1383577 | A | 4/2014 |
| KR | 10-2014-0119029 | A | 10/2014 |
| KR | 10-2016-0052607 | A | 5/2016 |
| KR | 10-2019-0020720 | A | 3/2019 |
| WO | 2018/167818 | A1 | 9/2018 |

OTHER PUBLICATIONS

International Search Report dated Jan. 21, 2021 from the International Searching Authority in International Application No. PCT/KR2020/006583.

Extended European Search Report dated Dec. 13, 2021 in European Application No. 20816076.2.

* cited by examiner

AEROSOL GENERATING DEVICE AND OPERATING METHOD THEREFOR

TECHNICAL FIELD

The present disclosure relates to an aerosol generating device and an operating method therefor.

BACKGROUND ART

Recently, the demand for alternative ways of overcoming the disadvantages of common cigarettes has increased. For example, there is growing demand for a method of generating aerosol by heating an aerosol generating material in cigarettes, rather than by combusting cigarettes. Accordingly, research into a heating-type cigarette and a heating-type aerosol generator has been actively conducted.

As needed, a user may smoke with an aerosol generating device connected to an external power supply source. In this case, power needs to be supplied to a battery for charging and to a heater for heating. As power needed for a heater changes over time according to a temperature profile, heating of a heater and charging of a battery may not be appropriately performed in a particular section. Therefore, there is a need for controlling power supplied to the heater and the battery such that heating of the heater and charging of the battery are performed stably and efficiently while the aerosol generating device is connected to the external power supply source.

DESCRIPTION OF EMBODIMENTS

Technical Problem

Provided are an aerosol generating device capable of stably and efficiently performing heating of a heater and charging of a battery while the aerosol generating device is connected to an external power supply source and an operating method therefor.

The technical problems to be solved by the present disclosure are not limited to the technical problems as described above, and other technical problems may be inferred from the following embodiments.

Solution to Problem

According to an aspect of the present disclosure, an aerosol generating device may include: a heater heating an aerosol generating material by power supplied; a battery storing power to be supplied to the heater; and a controller controlling power supply to the heater and power supply to the battery. The controller may monitor a heating state of the heater when the aerosol generating device is electrically connected to an external power supply source, perform heating of the heater without charging of the battery by the external power supply source if the monitored heating state is determined to be a rapid heating state, and control power supply to the heater and power supply to the battery to perform charging of the battery and heating of the heater together by the external power supply source if the monitored heating state is determined not to be the rapid heating state.

According to another aspect of the present disclosure, a method of operation of an aerosol generating device, may include: monitoring a heating state of a heater when the aerosol generating device is electrically connected to an external power supply source; performing heating of the heater without charging of a battery by the external power supply source if the monitored heating state is determined to be a rapid heating state; and performing charging of the battery and heating of the heater together by the external power supply source if the monitored heating state is determined not to be the rapid heating state.

Advantageous Effects of Disclosure

According to embodiments of the present disclosure, an aerosol generating device may control power supply from an external power supply source to a heater and a battery on the basis of a heating state of the heater while the aerosol generating device is connected to the external power supply source, thereby performing heating of the heater and charging of the battery stably and efficiently.

Also, according to embodiments of the present disclosure, charging of the battery is performed along with heating of the heater while the aerosol generating device is connected to the external power supply source, thereby reducing a time needed for charging the battery. As a result, convenience of a user may be increased.

BEST MODE

Figure 1:
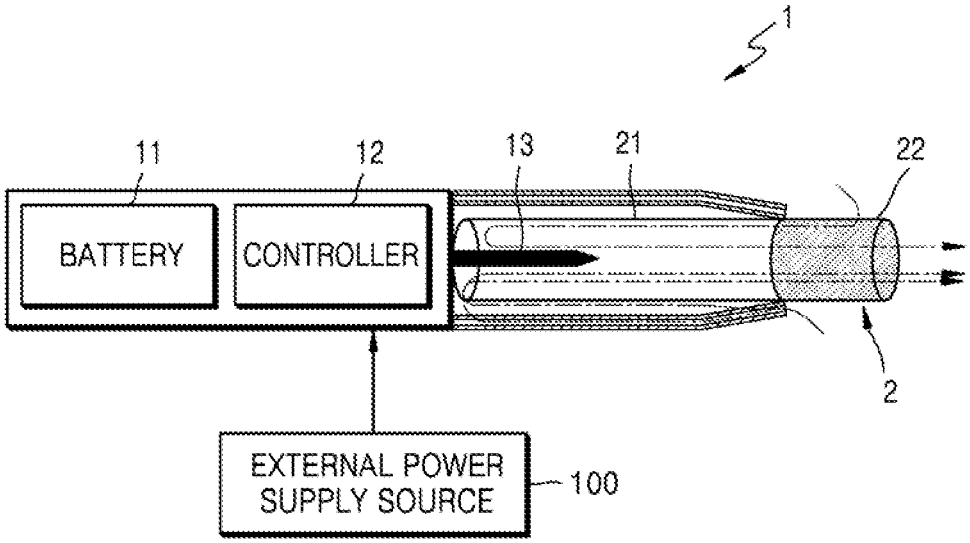
FIGS. 1 through 3 are diagrams illustrating examples of an aerosol generating device into which a cigarette is inserted and an external power supply source for supplying power to the aerosol generating device.

According to an aspect of the present disclosure, an aerosol generating device may include: a heater configured to heat an aerosol generating material by power supplied; a battery configured to store power to be supplied to the heater; and a controller configured to control power supply to the heater and power supply to the battery by performing operations of: monitoring a heating state of the heater when the aerosol generating device is electrically connected to an external power supply source; heating the heater without charging of the battery by the external power supply source based on the monitored heating state being a rapid heating state; and charging the battery and heating the heater simultaneously by the external power supply source based on the monitored heating state being not the rapid heating state.

The rapid heating state may be at least one of a heating state in a preheating section in which the temperature of the heater increases to a target temperature, a heating state in which the heater is supplied with power higher than or equal to reference power, a heating state in which the heater is supplied with a current higher than or equal to a reference current, and a heating state in which a change in the temperature of the heater is greater than or equal to a reference change.

When the aerosol generating device is electrically connected to the external power supply source, the controller may control power supply to the heater to interrupt power supply from the battery to the heater and perform heating of the heater by power supplied from the external power supply source to the heater.

When the monitored heating state is determined to be the rapid heating state, the controller may control the power supply to the battery to interrupt the power supply from the external power supply source to the battery.

When the monitored heating state is determined not to be the rapid heating state, the controller may control the power supply to the battery to supply power from the external power supply source to the heater and supply power from the external power supply source to the battery.

The controller may control power supply to the heater by controlling a first switching unit arranged on a power supply path from the battery to the heater and a second switching unit arranged on a power supply path from the external power supply source to the heater.

The external power supply source may be an external power supply device in which the aerosol generating device is detachably accommodated.

The controller may transmit information related to the monitored heating state to the external power supply device such that power supply from the external power supply device to the heater and the battery is controlled by operation of a switching unit included in the external power supply device.

According to another aspect of the present disclosure, a method of operation of an aerosol generating device, may include: monitoring a heating state of a heater when the aerosol generating device is electrically connected to an external power supply source; heating the heater without charging a battery by the external power supply source based on the monitored heating state being a rapid heating state; and charging the battery and heating the heater simultaneously by the external power supply source based on the monitored heating state being not the rapid heating state.

The method may further include: when the aerosol generating device is electrically connected to the external power supply source, interrupting power supply from the battery to the heater and performing heating of the heater by power supplied from the external power supply source to the heater.

The performance of the heating of the heater without the charging of the battery may include controlling power supply to the battery to interrupt the power supply from the external power supply source to the battery.

The performance of the charging of the battery and the heating of the heater together may include controlling the power supply to the battery to supply power from the external power supply source to the heater and supply power from the external power supply source to the battery.

Mode of Disclosure

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

The attached drawings for illustrating one or more embodiments are referred to in order to gain a sufficient understanding, the merits thereof, and the objectives accomplished by the implementation. The disclosure may, however, be embodied in many different forms and should not be construed as being limited to the embodiments set forth herein.

Hereinafter, embodiments of the present disclosure will be described in detail with reference to the drawings.

Figure 2:
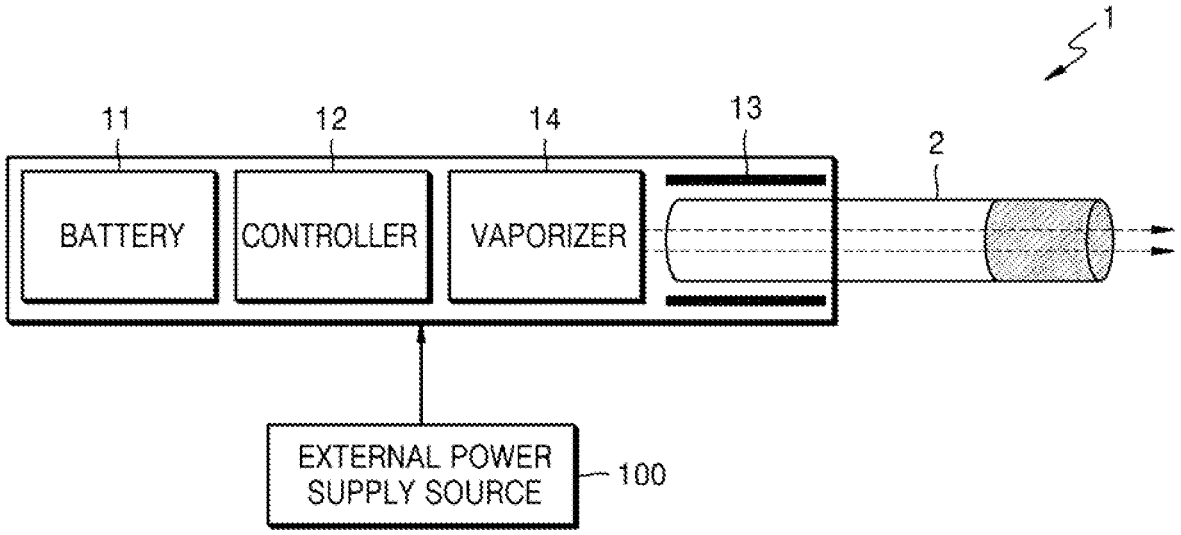
Figure 3:
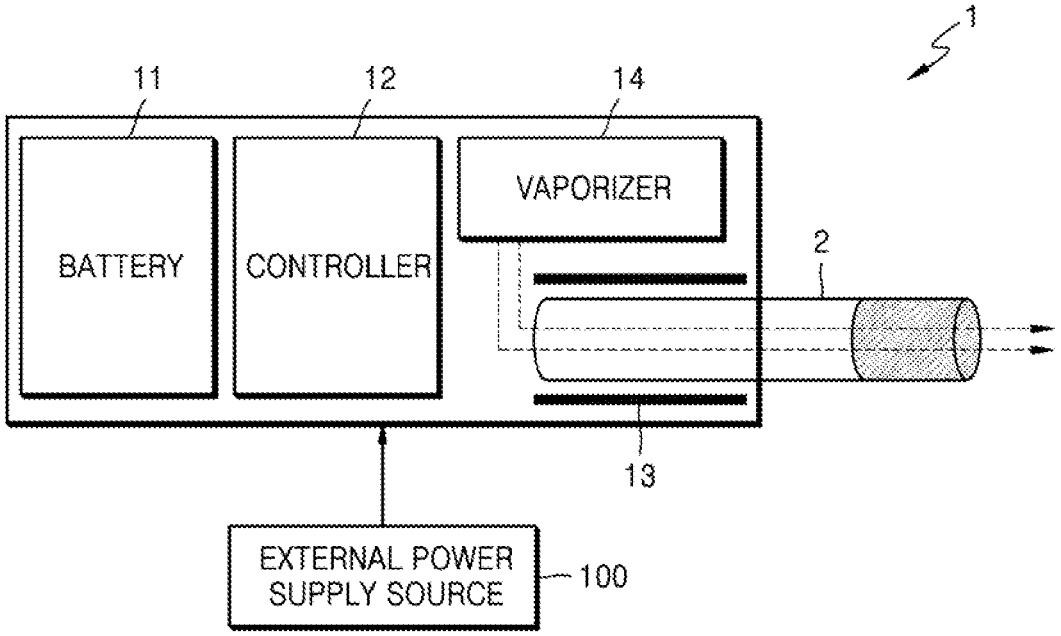

FIGS. 1 through 3 are diagrams illustrating examples of an aerosol generating device into which a cigarette is inserted and an external power supply source for supplying power to the aerosol generating device.

Referring to FIG. 1, an aerosol generating device 1 includes a battery 11, a controller 12, and a heater 13. Referring to FIGS. 2 and 3, the aerosol generating device 1 further includes a vaporizer 14. A cigarette 2 may be inserted into an internal space of the aerosol generating device 1. Also, the aerosol generating device 1 may be manufactured in a structure into which external air may be introduced or from which internal air may be discharged even when the cigarette 2 is inserted thereinto.

The cigarette 2 may be similar to a general combustive cigarette. For example, the cigarette 2 may be divided into a first portion including an aerosol generating material and a second portion including a filter and the like. For example, the first portion may be further divided into an aerosol substrate portion for generating an aerosol and a medium portion including a tobacco raw material. Alternatively, the second portion of the cigarette 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1. As another example, the entire first portion and a portion of the second portion may be inserted into the aerosol generating device 1. The user may puff aerosol while holding the second portion by the mouth of the user. In this case, an aerosol is generated by external air passing through the first portion, and the generated aerosol passes through the second portion and is delivered to the mouth of the user.

For example, the external air may flow into at least one air passage formed in the aerosol generating device 1. For example, opening and closing and/or a size of the air passage formed in the aerosol generating device 1 may be adjusted by the user. Accordingly, the amount of smoke and a smoking impression may be adjusted by the user. As another example, external air may flow into the cigarette 2 through at least one hole formed in a surface of the cigarette 2.

The elements related to the embodiment are illustrated in the aerosol generator 1 of FIGS. 1 to 3. Therefore, one of ordinary skill in the art would appreciate that other universal elements than the elements shown in FIGS. 1 to 3 may be further included in the aerosol generator 1.

In FIG. 1, the battery 11, the controller 12, and the heater 13 are arranged in a row. Also, FIG. 2 shows that the battery 11, the controller 12, the vaporizer 14, and the heater 13 are arranged in a row. Also, FIG. 3 shows that the vaporizer 14 and the heater 13 are arranged in parallel with each other. However, an internal structure of the aerosol generator 1 is not limited to the examples shown in FIGS. 1 to 3. That is, according to a design of the aerosol generator 1, arrangement of the battery 11, the controller 12, the heater 13, and the vaporizer 14 may be changed.

When the cigarette 2 is inserted into the aerosol generator 1, the aerosol generator 1 operates the heater 13 and/or the vaporizer 14 to generate aerosol from the cigarette 2 and/or the vaporizer 14. The aerosol generated by the heater 13 and/or the vaporizer 14 may be transferred to a user via the cigarette 2.

If necessary, even when the cigarette 2 is not inserted in the aerosol generator 1, the aerosol generator 1 may heat the heater 13. For example, the aerosol generating device 1 can heat heater 13 in a state in which the cigarette 2 is not inserted into the aerosol-generating device 1 in order to perform a cleaning operation to remove substances attached to the heater 13.

The heater 13 may be heated by the electric power supplied from the battery 11. For example, when the cigarette is inserted in the aerosol generator 1, the heater 13 may be located outside the cigarette. Therefore, the heated heater 13 may raise the temperature of an aerosol generating material in the cigarette.

The heater 13 may also be heated by power supplied from an external power supply source 100. For example, while the aerosol generating device 1 is electrically connected to the external power supply source 100, the heater 13 may be heated by receiving power from the external power supply source 100 not from the battery 11. Here, the external power supply source 100 includes any power sources capable of supplying power to the aerosol generating device 1. For example, the external power supply source 100 may include a fixed power source, an external power supply device for accommodating the aerosol generating device 1, such as a cradle device, a wired/wireless power transmission device, and the like, but is not limited thereto.

The external power supply source 100 may be electrically connected to the aerosol generating device 1. The aerosol generating device 1 may include a wired/wireless interfacing element which is electrically connected to the external power supply source 100. The aerosol generating device 1 may be supplied with power from the external power supply source 100 through the wired/wireless interfacing element.

For example, the aerosol generating device 1 may include a terminal for providing an electrical connection such as a USB port or an electrode, and may be electrically connected to the external power supply source 100 through the terminal. Also, the aerosol generating device 1 may include a power receiving element for receiving power wirelessly by, for example, an inductive coupling method based on a magnetic induction phenomenon or a magnetic resonance coupling method based on an electromagnetic resonance phenomenon, and may also be electrically connected to the external power supply source 100 through the power receiving element.

The heater 13 may be an electro-resistive heater. For example, the heater 13 includes an electrically conductive track, and the heater 13 may be heated as a current flows through the electrically conductive track. However, the heater 13 is not limited to the above example, and any type of heater may be used provided that the heater is heated to a desired temperature. Here, the desired temperature may be set in advance on the aerosol generator 1, or may be set by a user.

As another example, the heater 13 may be an induction heater. In detail, the heater 13 may include an electrically conductive coil for heating the cigarette 2 in an induction heating method, and the cigarette 2 may include a susceptor which may be heated by the induction heater.

For example, the heater 13 may include a tube-type heating element, a plate-type heating element, a needle-type heating element or a rod-type heating element and may heat the inside or the outside of the cigarette 2 according to the shape of the heating element.

Also, the aerosol generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate aerosol by heating a liquid composition and the generated aerosol may be delivered to the user after passing through the cigarette 2. In other words, the aerosol generated by the vaporizer 14 may move along an air flow passage of the aerosol generator 1, and the air flow passage may be configured for the aerosol generated by the vaporizer 14 to be delivered to the user through the cigarette.

For example, the vaporizer 14 may include a liquid storage unit, a liquid delivering unit, and a heating element, but is not limited thereto. For example, the liquid storage unit, the liquid delivering unit, and the heating element may be included in the aerosol generator 1 as independent modules.

The liquid storage may store a liquid composition. For example, the liquid composition may be a liquid including a tobacco containing material including a volatile tobacco flavor component, or a liquid including a non-tobacco material. The liquid storage unit may be attached to/detached from the vaporizer 14 or may be integrally manufactured with the vaporizer 14.

For example, the liquid composition may include water, solvents, ethanol, plant extracts, flavorings, flavoring agents, or vitamin mixtures. The flavoring may include, but is not limited to, menthol, peppermint, spearmint oil, various fruit flavoring ingredients, etc. The flavoring agent may include components that may provide the user with various flavors or tastes. Vitamin mixtures may be a mixture of at least one of vitamin A, vitamin B, vitamin C, and vitamin E, but are not limited thereto. Also, the liquid composition may include an aerosol former such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element of the vaporizer 14 is an element for heating a liquid composition transferred by the liquid delivery element. For example, the heating element of the vaporizer 14 may be a metal heating wire, a metal hot plate, a ceramic heater, or the like but is not limited thereto. The heating element may include a conductive filament such as a nichrome wire and may be positioned as being wound around the liquid delivery element. The heating element may be heated by a current supply and may transfer heat to the liquid composition in contact with the heating element, thereby heating the liquid composition. As a result, aerosol may be generated.

The vaporizer 14 may be referred to as various terms such as a cartomizer or an atomizer.

The battery 11 stores power to be used for the aerosol generating device 1 to operate. The battery 11 may supply power to heat the heater 13 and/or the vaporizer 14 and may supply power to be used for the controller 12 to operate. Also, the battery 11 may supply power for operating a display, a sensor, a motor, and the like installed in the aerosol generating device 1.

The battery 11 is a rechargeable battery. For example, the battery 11 may be a lithium polymer (LiPoly) battery but is not limited thereto. The battery 11 may be charged by power supplied from the external power supply source 110.

Although not illustrated in FIGS. 1 through 3, the aerosol generating device 1 may constitute a system along with an external power supply device (3 of FIG. 7) such as an additional cradle device. For example, the external power supply device may be used to charge the battery 11 of the aerosol generating device 1. Also, while the external power supply device and the aerosol generating device 1 are coupled to each other, the heater 13 and/or the vaporizer 14 may be heated.

The controller 12 generally controls operations of the aerosol generating device 1. In detail, the controller 12 controls not only operations of the battery 11, the heater 13, and the vaporizer 14 but also operations of other components included in the aerosol generating device 1. Also, the controller 12 may check a state of each of the components of the aerosol generating device 1 to determine whether or not the aerosol generating device 1 is able to operate.

The controller 12 includes at least one processor. A processor can be implemented as an array of a plurality of logic gates or can be implemented as a combination of a general-purpose microprocessor and a memory in which a program executable in the microprocessor is stored. It will be understood by one of ordinary skill in the art that the present disclosure may be implemented in other forms of hardware.

The controller 12 may acquire sensing data by using at last one sensor included in the aerosol generating device 1, and control the heater 13 and the vaporizer 14 to perform various functions according to the acquired sensing data, such as charging the battery 11, limiting smoking, determining whether or not a cigarette (or a cartridge) is inserted, displaying a notification, and the like.

The controller 12 controls power supply to the heater 13 and/or the vaporizer 14. The controller 12 may start or stop the power supply to the heater 13 and/or the vaporizer 14 according to a result sensed by at least one sensor included in the aerosol generating device 1. The controller 12 may control the amount of power supplied to the heater 13 and/or the vaporizer 14 and a time when power is supplied to the heater 13 and/or the vaporizer 14, such that the heater 13 and/or the vaporizer 14 is heated to a preset temperature or maintains an appropriate temperature. The controller 12 may supply power to the heater 13 and/or the vaporizer 14 even when the aerosol generating device 1 is connected to the external power supply source 100.

The controller 12 may detect whether or not the aerosol generating device 1 is electrically connected to the external power supply source 100. When the controller 12 detects that the aerosol generating device 1 is electrically connected to the external power supply source 100, the controller 12 may monitor a heating state of the heater 13 and/or the vaporizer 13 and control power supply from the external power supply source 100 for heating the heater 13 and/or the vaporizer 14 and charging the battery 11 on the basis of the monitored heating state.

Hereinafter, a method of controlling heating and charging when the aerosol generating device 1 is electrically connected to the external power supply source 100 will be described in detail. In relation to the method of controlling heating, a description will be given focusing on a method of controlling heating of the heater 13 for convenience, but the following description will also be similarly applied to a method of controlling heating of the vaporizer 14.

Figure 4:
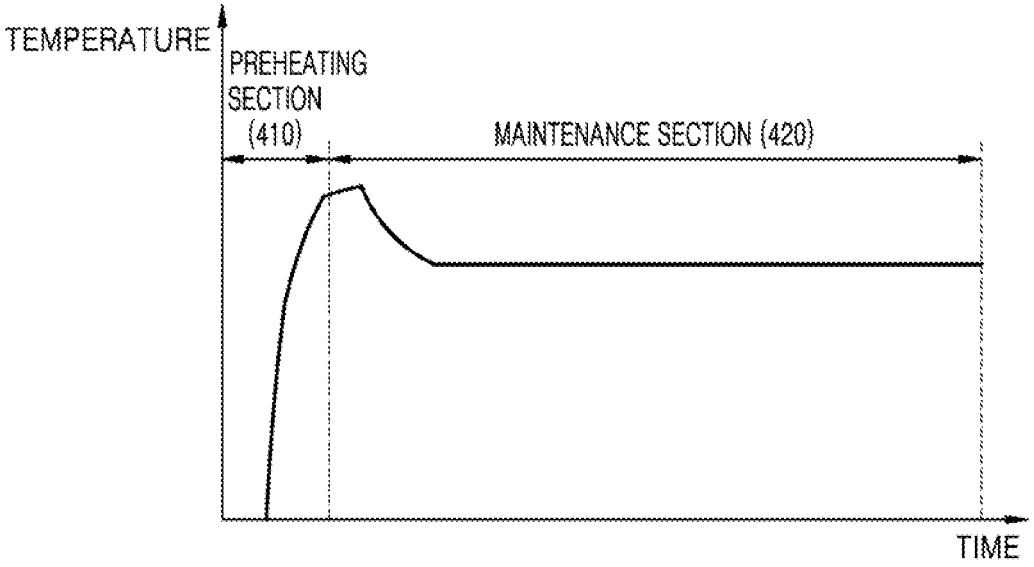
FIGS. 4 and 5 are graphs for explaining a method of controlling heating of a heater and charging of a battery according to a heating state of the heater.
Figure 5:
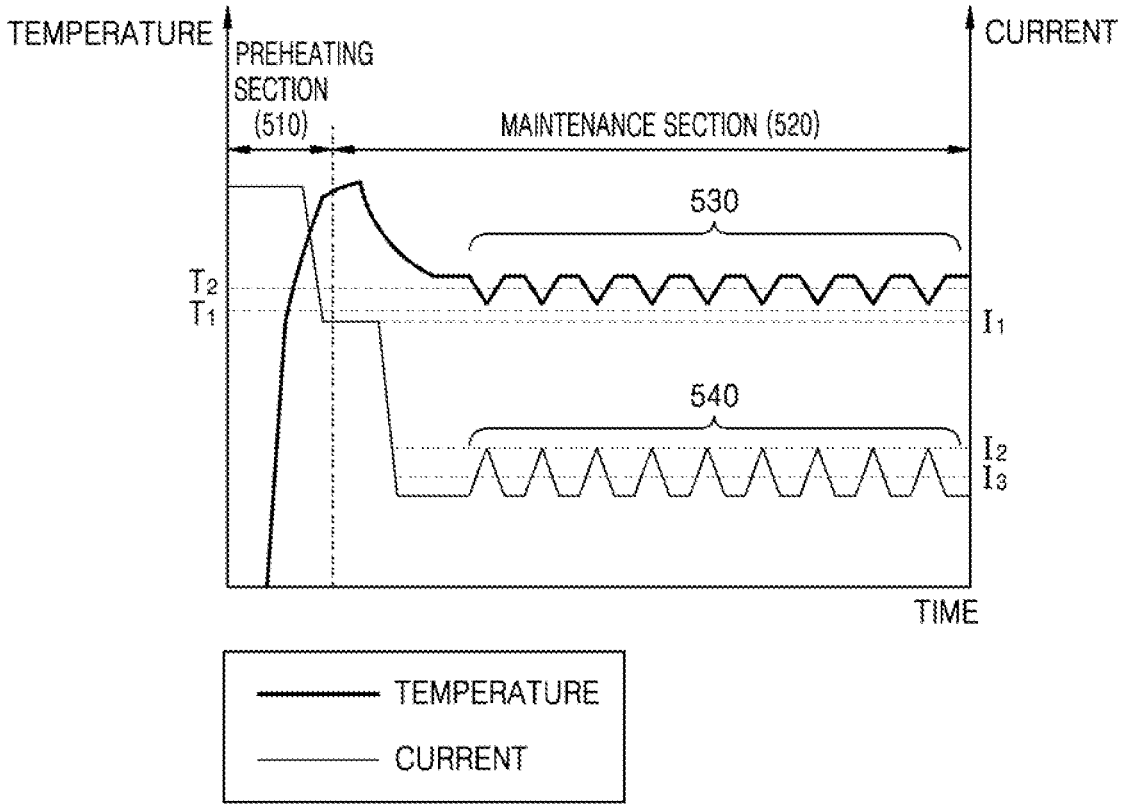

FIGS. 4 and 5 are graphs for explaining a method of controlling heating of a heater and charging of a battery according to a heating state of the heater.

FIG. 4 illustrates an example of a change in temperature of the heater 13 according to a preset temperature profile while heating of the heater 13 is performed. The controller 12 controls power supplied to the heater 13 on the basis of a preset temperature profile. For example, the preset temperature profile may include a temperature profile of a preheating section 410 and a temperature profile of a maintenance section 420. On the basis of the temperature profile of the preheating section 410, the controller 12 may control power supplied to the heater 13 such that the heater 13 is heated to a target temperature. Also, on the basis of the temperature profile of the maintenance section 420, the controller 12 may control power supplied to the heater 13 such that the temperature of the heater 13 is maintained at a preset temperature (or within a preset temperature range).

The change in the temperature of the heater 13 according to the temperature profiles in the preheating section 410 and the maintenance section 420 is not limited to the example illustrated in FIG. 4. For example, each of the preheating section 410 and the maintenance section 420 may be further divided into a plurality of sections. Also, the temperature of the heater 13 may rise to a target temperature corresponding to each section of the preheating section 410, or the temperature of the heater 13 may be maintained at a preset temperature (within a preset temperature range) corresponding to each section of the maintenance section 420.

In the preheating section 410, a high level of power is supplied to the heater 13 for a relatively short time such that the temperature of the heater 13 reaches a target temperature as quickly as possible. In the maintenance section 420, power supplied to the heater 13 may be lower than in the preheating section 410 such that the temperature of the heater 13 is maintained.

In the case where the aerosol generating device 1 is electrically connected to the external power supply source 100, if charging of the battery 11 is performed along with heating of the heater 13 in a section in which a high level of power is supplied to the heater 13 for a relatively short time, such as the preheating section 410, charging of the battery 11 may not be performed efficiently. Also, in this case, as a high level of power is output from the battery 11 and simultaneously charging for the battery 11 is performed, an operation error of a charging/discharging circuit of the battery 11 may occur. As a result, heating of the heater 13 and charging of the battery 11 may not be performed stably.

Therefore, when heating of the heater 13 is performed while the aerosol generating device 1 is electrically connected to the external power supply source 100, heating of the heater 13 and charging of the battery 11 need to be controlled in consideration of a heating state of the heater 13.

The controller 12 according to an embodiment of the present disclosure monitors a heating state of the heater 13 when the aerosol generating device 1 is electrically connected to the external power supply source 110. The controller 12 may monitor the heating state of the heater 13 based on data related to heating of the heater 13, such as time elapsed from the start of heating of the heater 13, a temperature of the heater 13, a level of power supplied to the heater 13, a level of current supplied to the heater 13, and the like.

When the monitored heating state of the heater 13 is determined to be a rapid heating state, the controller 12 may control power supplied to the heater 13 and the battery 11 such that heating of the heater 13 is performed without charging the battery 11 by the external power supply source 100. Also, when the monitored heating state of the heater 13 is determined not to be the rapid heating state, the controller 12 may control the power supplied to the heater 13 and the batter 11 such that charging of the battery 11 and heating of the heater 13 by the external power supply source 100 may be performed together.

Here, the rapid heating state refers to a heating state in which a high level of power is needed to increase the temperature of the heater 13 within a relatively short time. For example, the rapid heating state may include a heating state in a preheating section in which the temperature of the heater 13 rises to a target temperature, a heating state in which the heater 13 is supplied with power higher than or equal to reference power, a heating state in which the heater 13 is supplied with a current higher than or equal to a reference current, and a heating state in which a change in the temperature of the heater 13 is greater than or equal to a reference change.

FIG. 5 is a graph illustrating another example of a change in temperature of the heater 13 according to a preset temperature profile while heating of the heater 13 is performed.

In an embodiment, when the controller 12 identifies that a section in which heating of the heater 13 is performed corresponds to a preheating section 510, the controller 12 may determine that a heating state of the heater 13 is a rapid heating state. When the controller 12 identifies that the second in which heating of the heater 13 is performed corresponds to a maintenance section 520, the controller 12 may determine that the heating state of the heater 13 is not the rapid heating state. For example, the controller 12 may identify whether or not the current section corresponds to the preheating section 510, on the basis of whether or not a preset time has passed after the temperature of the heater 13 reaches a target temperature. As another example, the controller 12 may identify whether or not the current section corresponds to the preheating section 510, on the basis of whether or not a current supplied to the heater 13 is greater than or equal to a preset current (e.g., or whether or not power supplied to the heater 13 is greater than or equal to preset power.

Even after the preheating section 510 is completed, the maintenance section 520 may include a section in which a high level of power is supplied to the heater 13 instantaneously to increase the temperature of the heater 13. For example, a section 530 in which the temperature of the heater 13 decreases by puffs of a user may correspond to such section. In this case, as in a section 540, a high level of power may be supplied to the heater 13 instantaneously to increase the decreased temperature of the heater 13 to an appropriate temperature.

Therefore, the controller 12 may control power supplied to the heater 13 and the battery 11 on the basis of whether or not the heating state 13 is the rapid heating state, such that heating of the heater 13 and charging of the batter 11 are performed efficiently and stably in the entire heating section including the preheating section 510 and the maintenance section 520.

In an embodiment, when the controller 12 identifies that heating of the heater 13 is performed by supplying the heater 13 with power higher than or equal to reference power, the controller 12 may determine that the heating state of the heater 13 is the rapid heating state. Here, the reference power may be a preset power value and may be one particular power value or may include a plurality of power values which are set differently according to heating sections of the heater 13. For example, reference power corresponding to the preheating section 510 may be set higher than reference power corresponding to the maintenance section 520.

In an embodiment, when the controller 12 identifies that heating or the heater 13 is performed by supplying the heater 13 with a current higher than or equal to a reference current, the controller 12 may determine that the heating state of the heater 13 is the rapid heating state. Here, the reference current may be a preset current value and may be one particular current value or may include a plurality of current values which are set differently according to the heating sections of the heater 13.

For example, a reference current corresponding to the preheating section 510 may be set to $I_1$, and a reference current corresponding to the maintenance section 520 may be set to $I_2$ or $I_3$. When the reference current is $I_2$, the heating state of the heater 13 may be determined not to be the rapid heating state in the section 540, and charging of the battery 11 and heating of the heater 13 may be performed together in the entire section 540. When the reference current is $I_3$, the heating state of the heater 13 may be determined not to be the rapid heating state in a section in which a current lower than $I_3$ is supplied to the heater 13, and charging of the battery 11 and heating of the heater 13 may be performed together only in such section.

In an embodiment, when the controller 12 identifies that a change in the temperature of the heater 13 is greater than or equal to a reference change, the controller 12 may determine that the heating state of the heater 13 is the rapid heating state. Here, the reference change may be a preset temperature change and may be one particular value or may include a plurality of values which are set differently according to the heating sections of the heater 13.

For example, when the temperature of the heater 13 increases from $T_1$ to $T_2$ and a temperature change ($T_2$–$T_1$) is greater than or equal to a reference change, the heating state of the heater 13 may be determined to be the rapid heating state. A heating state in which a rapid increase in the temperature of the heater 13 is expected may also be included in the rapid heating state. For example, when the temperature of the heater 13 decreases from $T_2$ to $T_1$ and a temperature change $|T_2-T_1|$ is greater than or equal to the reference change, the heating state of the heater 13 may be determined to be the rapid heating state. This is because when the temperature of the heater 13 decreases greater than or equal to the reference change, the temperature of the heater 13 may be expected to increase rapidly to an appropriate temperature.

Hereinafter, paths through which a heater and a battery in an aerosol generating device are supplied with power will be described with reference to FIGS. 6 through 10.

The aerosol generating device may be embodied as a separate type or an integral type. The separate type aerosol generating device may constitute a system along with an external power supply device (e.g., a cradle device) including an internal space for accommodating the aerosol generating device, and may be implemented in a structure which may be attached to and detached from the external power supply device. The integral type aerosol generating device may be implemented not to constitute a system with the external power supply device.

For example, when the aerosol generating device 1 described with reference to FIGS. 1 through 3 is a separate type, the external power supply source 100 may be the external power supply device. When the aerosol generating device 1 is an integral type, the external power supply source 100 may be a random external power source (60 of FIG. 6) except the external power supply device.

According to a type of aerosol generating device, power supply to a heater and power supply to a battery may be controlled differently. A method of controlling an integral type aerosol generating device will be described with reference to FIG. 6.

Figure 6:
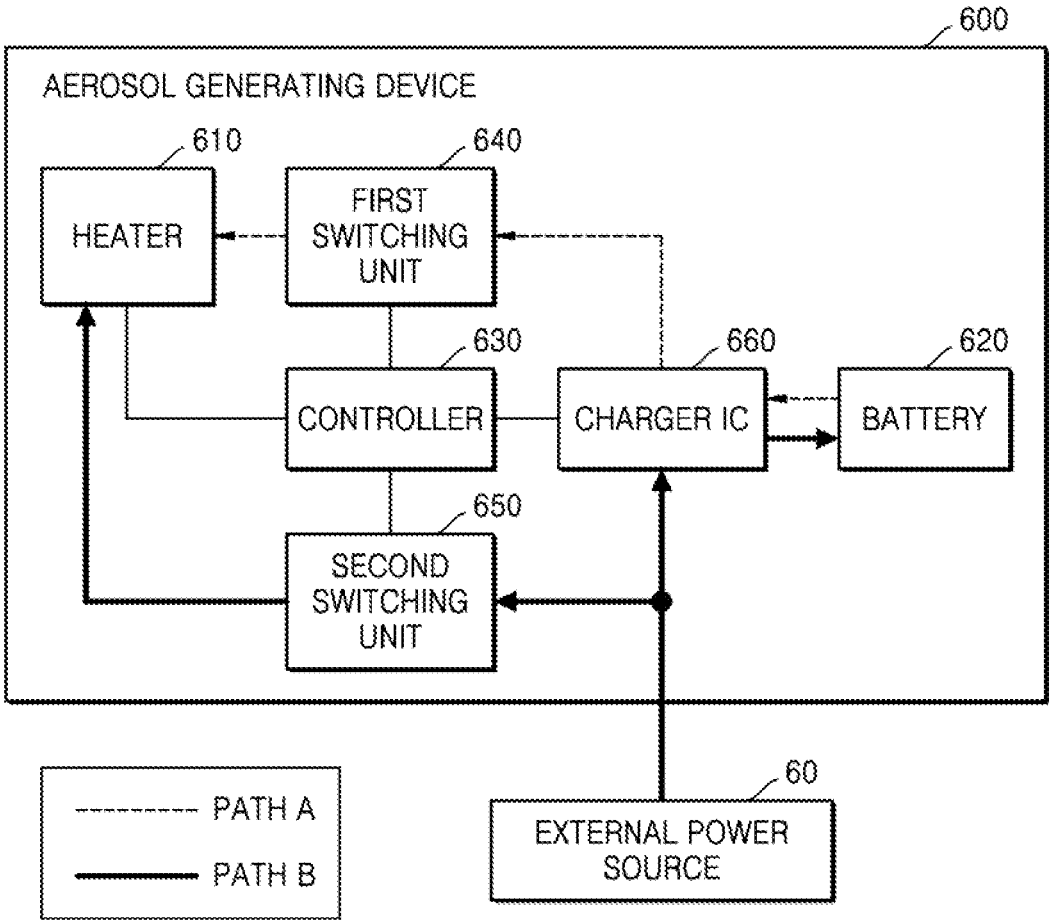
FIG. 6 is a block diagram for explaining paths through which a heater and a battery in an integral-type aerosol generating device according to an embodiment are supplied with power.

FIG. 6 is a block diagram for explaining paths through which a heater and a battery in an integral type aerosol generating device according to an embodiment are supplied with power.

An aerosol generating device 600 may include a heater 610, a battery 620, a controller 630, a first switching unit 640, a second switching unit 650, and a charger integrated circuit (IC) 660.

The first switching unit 640 is arranged on a power supply path through which power is supplied from the battery 620 to the heater 610, and the second switching unit 650 is arranged on a power supply path through which power is supplied from an external power source 60 to the heater 610.

The charger IC 660 supplies the battery 620 and the heater 610 with power supplied from the external power source 60. For example, the charger IC 660 may convert power supplied from the external power source 60 into power appropriate for charging the battery 620 and power appropriate for heating the heater 610.

When the aerosol generating device 600 is not electrically connected to the external power source 60, the controller 630 may control the first switching unit 640 and the charger IC 660 to supply power from the battery 620 to the heater 610 along a path A.

When the aerosol generating device 600 is electrically connected to the external power source 60, the controller 630 may control the first switch unit 640 to interrupt power supply from the battery 620 to the heater 610 along the path A. Also, the controller 630 may control power supply to the heater 610 and the battery 620 such that heating of the heater 610 and charging of the battery 620 are performed by power supplied along a path B.

In detail, when a monitored heating state of the heater 610 is determined to a rapid heating state, the controller 630 may control the charger IC 660 not to supply power from the external power source 60 to the battery 620 and may control the second switching unit 650 to supply power from the external power source 60 to the heater 610. When the monitored heating state of the heater 610 is determined not to be the rapid heating state, the controller 630 may the charger IC 660 to supply power from the external power source 60 to the heater 60 and supply power from the external power source 60 to the battery 620.

Hereinafter, a method of controlling a separate type aerosol generating device will be described with reference to FIGS. 7 through 10.

Figure 7:
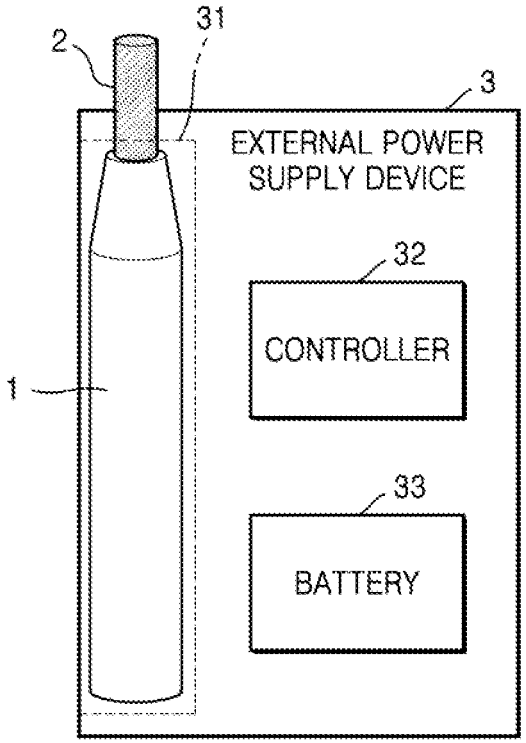
FIGS. 7 and 8 are views illustrating examples in which a separable-type aerosol generating device is accommodated in an external power supply device.
Figure 8:
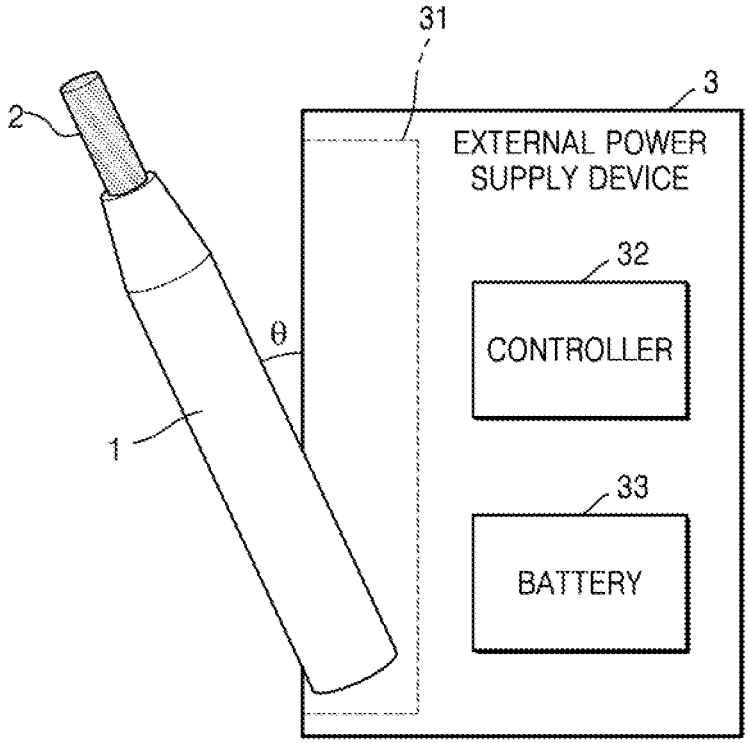

FIGS. 7 and 8 are views illustrating examples in which a separate type aerosol generating device is accommodated in an external power supply device.

The above description may be similarly applied to each of an aerosol generating device 1 and an external power supply device 3 illustrated in FIGS. 7 and 8 to the extent that their descriptions do not contradict. Therefore, the duplicate description will be omitted herein.

The aerosol generating device 1 may be accommodated in the external power supply device 3 in such a way that it may be detachable from the external power supply device 3. While a cigarette 2 is inserted into an internal space of the aerosol generating device 1, a user may smoke by using the aerosol generating device 1 alone, or may smoke while the aerosol generating device 1 is coupled to the external power supply device 3 as illustrated in FIG. 7. Also, as illustrated in FIG. 8, the user may smoke by tilting the aerosol generating device 1 at a certain angle.

The external power supply device 3 includes a controller 32 and a battery 33. Also, the external power supply device 3 includes an internal space 31 in which the aerosol generating device 1 may be accommodated. For example, the internal space 31 may be formed close to a side. Therefore, even when the external power supply device 3 does not include an additional cap, the aerosol generating device 1 may be inserted into and fixed to the external power supply device 3.

The controller 32 generally controls operations of the external power supply device 3. The controller 32 may determine whether or not the external power supply device 3 and the aerosol generating device 1 are coupled to each other, and control operations of the external power supply device 3 according to the determined coupling state. For example, when the aerosol generating device 1 is coupled to the external power supply device 3, the controller 32 may charge a battery of the aerosol generating device 1 or heat a heater of the aerosol generating device 1, by supplying power of the battery 33 to the aerosol generating device 1.

The controller 32 includes at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor may be implemented in other forms of hardware.

The battery 33 supplies power to be used for the external power supply device 3 to operate. Also, the battery 33 supplies power to be used for operating and charging the aerosol generating device 1.

The external power supply device 3 and the aerosol generating device 1 may include communication interfacing modules for performing wire communication (e.g., USB) or wireless communication (e.g., WI-FI, WI-FI Direct, Bluetooth, near field communication (NFC), or the like) and may communicate with each other through the communication interfacing modules.

Figure 9:
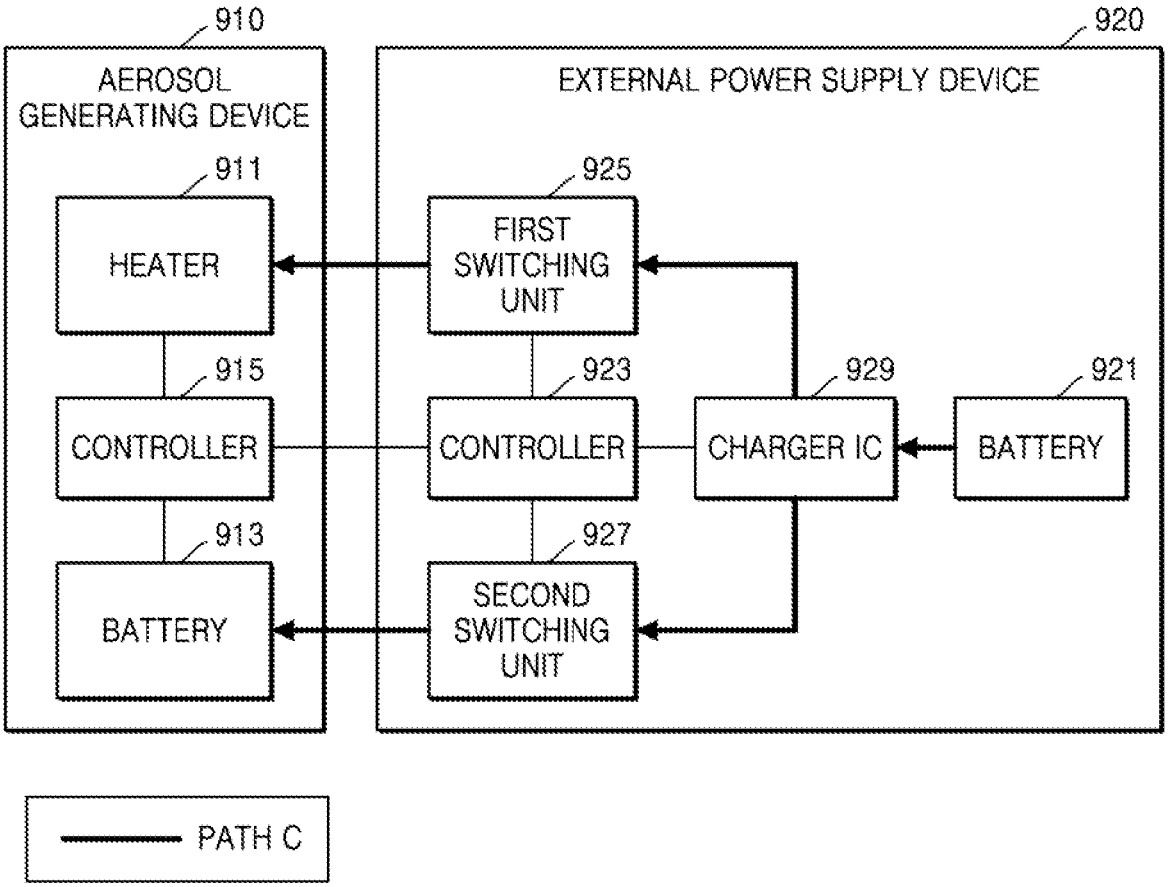
FIGS. 9 and 10 are block diagrams for explaining paths through which a heater and a battery in a separable-type aerosol generating device according to an embodiment are supplied with power.
Figure 10:
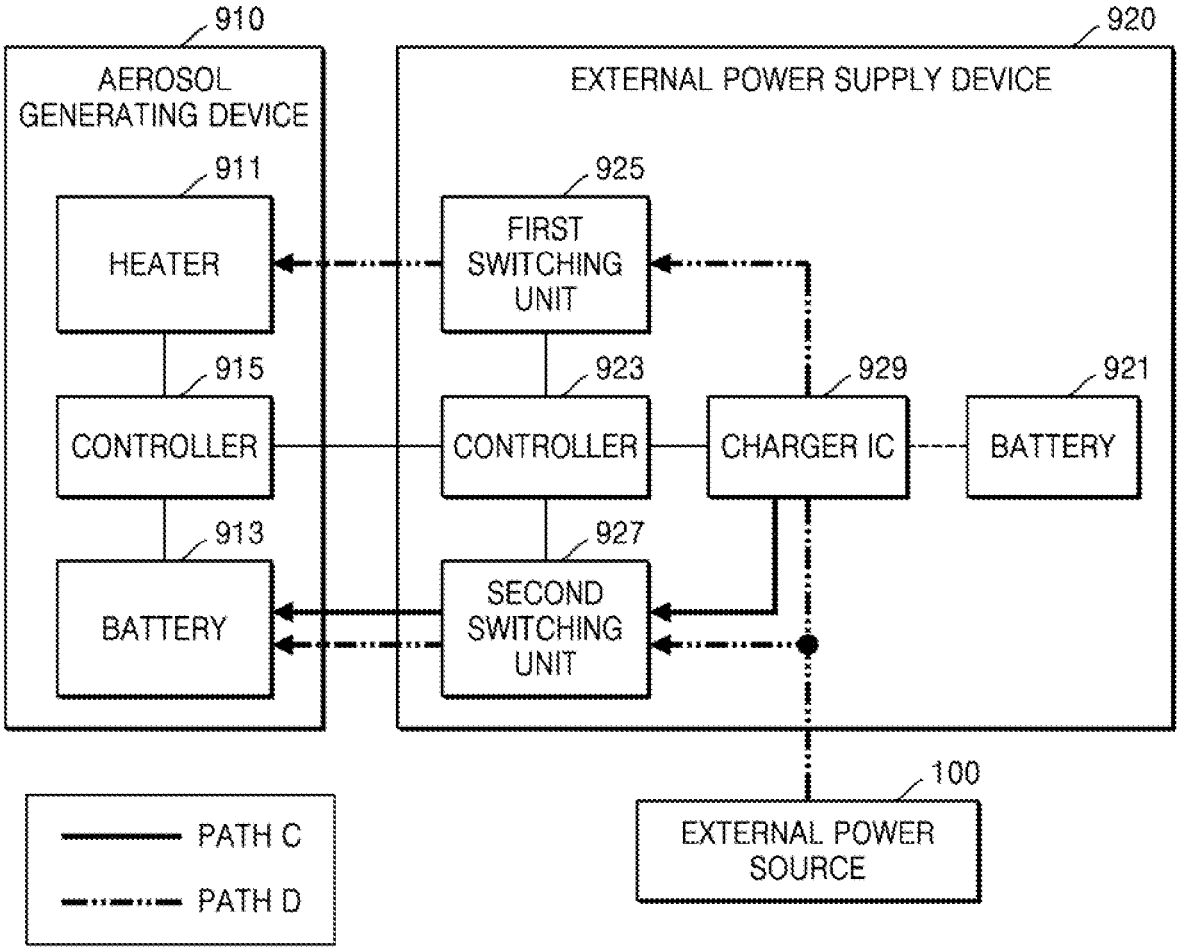

FIGS. 9 and 10 are block diagrams for explaining paths through which a heater and a battery in a separate type aerosol generating device according to an embodiment are supplied with power. FIG. 9 illustrates that an external power supply device is not connected to an external power source, and FIG. 10 illustrates that the external power supply device is connected to the external power source.

Referring to FIG. 9, an aerosol generating device 910 includes a heater 911, a battery 913, and a controller 915. An external power supply device 920 may include a battery 921, a controller 923, a first switching unit 925, a second switching unit 927, and a charger IC 929.

The first switching unit 925 is arranged on a power supply path through which power is supplied from the battery 921 to the heater 911, and the second switching path 927 is arranged on a power supply path through which power is supplied from the battery 921 to the battery 913.

The charger IC 929 supplies the battery 913 and the heater 911 with power supplied from the battery 921. For example, the charger IC 929 may convert power supplied from the battery 921 into power appropriate for charging the battery 913 and power appropriate for heating the heater 911.

When the aerosol generating device 910 is electrically connected to the external power supply device 920, the controller 915 of the aerosol generating device 910 may interrupt power supply from the battery 913 to the heater 911. Also, the controller 915 may control power supply to the heater 911 and the battery 913 such that heating of the heater 911 and charging of the battery 913 are performed by power supplied along a path C.

In an embodiment, the controller 915 may transmit, to the external power supply device 920, information related to a monitored heating state of the heater 911 to control power supply from the battery 921 of the external power supply device 920 to the heater 911 and the battery 913 by operations of the first switching unit 925 and the second switching unit 927 included in the external power supply device 920.

For example, the information related to the heating state of the heater 911 may include at least one of a time elapsed from the start of heating of the heater 911, a temperature of the heater 911, a level of power supplied to the heater 911, and a level of current supplied to the heater 911, but is not limited thereto.

The controller 923 may control the first switching unit 925, the second switching unit 927, and the charger IC 929 by using information received from the aerosol generating device 910 such that heating of the heater 911 and charging of the battery 913 are performed by power supplied along the path C.

In detail, when the information related to the heating state of the heater 911 indicates a rapid heating state, the controller 923 may control the second switching unit 927 and the charger IC 929 not to supply power from the battery 921 of the external power supply device 920 to the battery 913 of the aerosol generating device 910 and may control the first switching unit 925 to supply power from the battery 921 to the heater 911. When the information related to the heating state of the heater 911 does not indicate the rapid heating state, the controller 923 may control the second switching unit 927 to supply power from the battery 921 to the heater 911 and the battery 913.

According to another embodiment, the controller 923 of the external power supply device 920 may directly monitor the heating state of the heater 911 and determine whether or not the monitored heating state of the heater 911 is the rapid heating state to control power supply from the battery 921 to the heater 911 and the battery 913.

Referring to FIG. 10, the external power supply device 920 may be electrically connected to an external power source 100. In this case, power may be supplied to the heater 911 and the battery 913 of the aerosol generating device 910 along any one of the path C and a path D. The path C indicates a power supply path from the battery 921 of the external power supply device 920, and the path D indicates a power supply path from the external power source 100 connected to the external power supply device 920. For example, when the external power source 100 is connected to the external power supply device 920, the power supply path along the path C may be changed to the power supply path along the path D or a power supply path along any one of the path C and the path D may be selectively formed.

With respect to the path D, when the information related to the heating state of the heater 911 indicates the rapid heating state, the controller 923, the controller 923 may control the second switching unit 927 not to supply power from the external power source 100 to the battery 913 of the aerosol generating device 910 and may control the charger IC 929 and the first switching unit 925 to supply power from the external power source 100 to the heater 911. When the information related to the heating state of the heater 911 does not indicate the rapid heating state, the controller 923 may control the second switching unit 927 to supply power from the external power source 100 to the heater 911 and the battery 913.

Hereinafter, a method of operating an aerosol generating device according to some embodiments will be described with reference to FIGS. 11 and 12.

Figure 11:
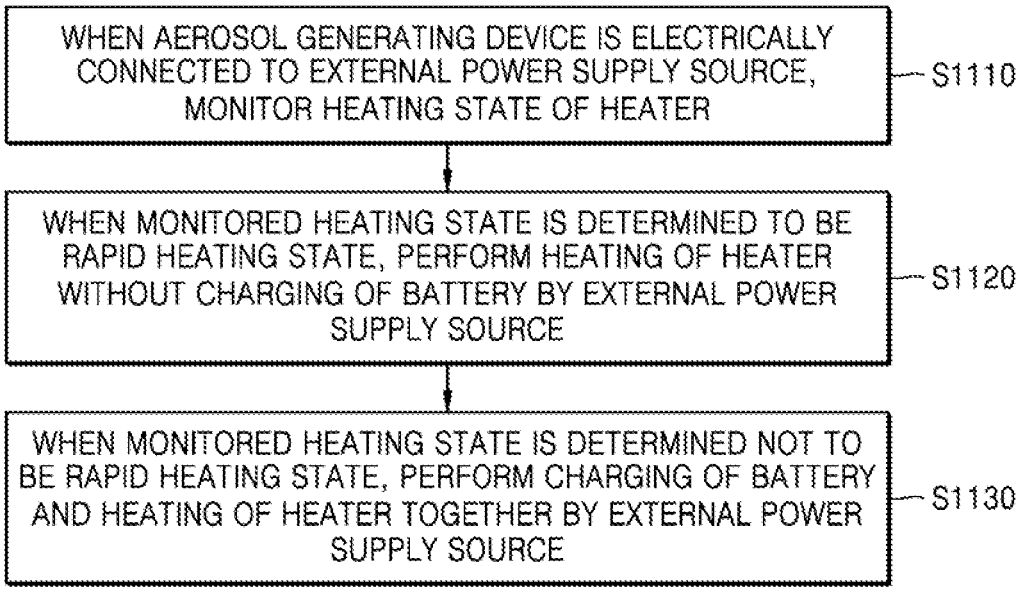
FIG. 11 is a flowchart illustrating a method of operation of an aerosol generating device according to an embodiment.

FIG. 11 is a flowchart illustrating a method of operating an aerosol generating device according to an embodiment.

In operation S1110, when an aerosol generating device is electrically connected to an external power supply source, the aerosol generating device monitors a heating state of a heater. The aerosol generating device may monitor the heating state of the heater on the basis of data which is related to heating of the heater. The data may indicate at least one of a time elapsed from the start of heating of the heater, a temperature of the heater, a level of power supplied to the heater, a level of current supplied to the heater, and the like.

In operation S1120, when the monitored heating state of the heater is determined to be a rapid heating state, the aerosol generating device performs heating of the heater without charging a battery by the external power supply source. Operation S1120 may include operation of controlling power supply to the battery to interrupt the power supply from the external power supply source to the battery.

Here, the rapid heating state refers to a heating state in which a high level of power is needed to increase the temperature of the heater within a relatively short time. For example, the rapid heating state may include a heating state in a preheating section in which the temperature of the heater increases to a target temperature, a heating state in which the heater is supplied with power higher than or equal to reference power, a heating state in which the heater is supplied with a current higher than or equal to a reference current, and a heating state in which a change in the temperature of the heater is greater than or equal to a reference change.

In operation S1130, when the monitored heating state of the heater is determined not to be the rapid heating state, the aerosol generating device performs heating of the heater and charging of the battery together by the external power supply source. Operation S1130 may include operation of controlling power supply to the battery to supply power from the external power supply source to the heater and supply power from the external power supply source to the battery.

Figure 12:
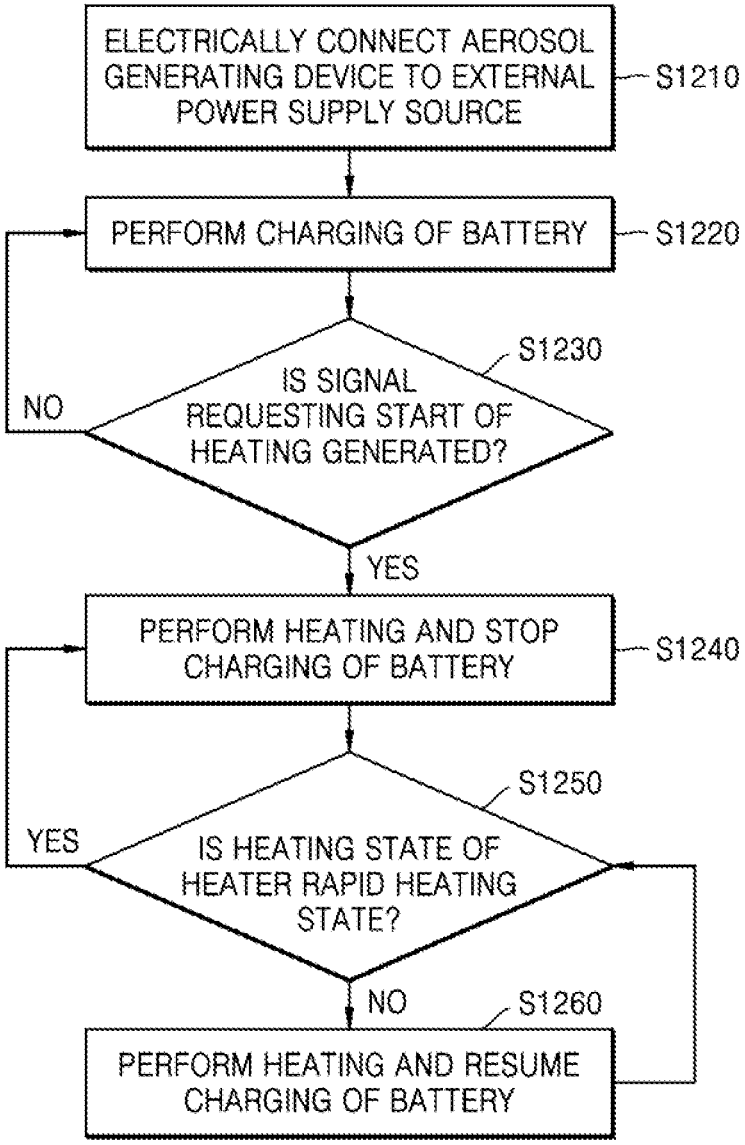
FIG. 12 is a flowchart illustrating a method of operation of an aerosol generating device according to another embodiment.

FIG. 12 is a flowchart illustrating a method of operating an aerosol generating device according to another embodiment.

In operation S1210, an aerosol generating device is electrically connected to an external power supply source. The aerosol generating device may detect whether or not the aerosol generating device is electrically connected to the external power supply source. When the aerosol generating device detects that the aerosol generating device is electrically connected to the external power supply source, the aerosol generating device may perform charging of the battery by power supplied from the external power supply source in operation S1220.

In operation S1230, the aerosol generating device may detect whether or not a signal requesting a start of heating of the heater is generated. For example, the signal requesting the start of heating of the heater may be a signal input by a user through an input unit included in the aerosol generating device, a signal indicating insertion (coupling) of a cigarette or a cartridge, or the like, but is not limited thereto.

When the generation of the signal requesting the start of heating of the heater is not detected, the aerosol generating device may charge the battery continuously. When the generation of the signal requesting the start of heating of the heater is detected, the aerosol generating device may perform heating of the heater and stop charging of the battery in operation S1240.

In operation S1250, the aerosol generating device may monitor a heating state of the heater and determine whether or not the monitored heating state of the heater is a rapid heating state. When the monitored heating state of the heater is determined to be the rapid heating state, the aerosol generating device may perform heating of the heater without continuously charging the battery. When the monitored heating state of the heater is determined not to be the rapid heating state, the aerosol generating device may resume charging of the battery which has been stopped, such that heating of the heater and charging of the battery are performed together in operation S1260.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the forgoing description, and all differences within the scope of the equivalents thereof should be construed as being included in the present disclosure.

INDUSTRIAL APPLICABILITY

An embodiment of the present disclosure may be used to manufacture next-generation electronic tobaccos which perform heating of heaters and charging of batteries efficiently.

What is claimed is:

1. An aerosol generating device comprising:

a heater configured to heat an aerosol generating material by power supplied;

a battery configured to store power to be supplied to the heater; and a controller configured to control power supply to the heater and the battery by performing operations of:

monitoring a heating state of the heater when the aerosol generating device is electrically connected to an external power supply source;

heating the heater without charging of the battery by the external power supply source based on the monitored heating state being a rapid heating state; and charging the battery and heating the heater simultaneously by the external power supply source based on the monitored heating state being not the rapid heating state.

2. The aerosol generating device of claim 1, wherein the rapid heating state is a heating state in a preheating section in which the temperature of the heater increases to a target temperature.

3. The aerosol generating device of claim 1, wherein the rapid heating state is a heating state in which the heater is supplied with power higher than or equal to reference power.

4. The aerosol generating device of claim 1, wherein the rapid heating state is a heating state in which the heater is supplied with a current higher than or equal to a reference current.

5. The aerosol generating device of claim 1, wherein the rapid heating state is a heating state in which a change in temperature of the heater is greater than or equal to a reference change.

6. The aerosol generating device of claim 1, wherein the controller is further configured to control the power supply to the heater by controlling a first switching unit arranged on a power supply path from the battery to the heater and a second switching unit arranged on a power supply path from the external power supply source to the heater.

7. The aerosol generating device of claim 1, wherein the external power supply source is an external power supply device in which the aerosol generating device is detachably accommodated.

8. The aerosol generating device of claim 7, wherein the controller is further configure to transmit information related to the monitored heating state to the external power supply device such that power supply from the external power supply device to the heater and the battery is controlled by operation of a switching unit included in the external power supply device.

9. The aerosol generating device of claim 1, wherein the controller is further configured to, when the aerosol generating device is electrically connected to the external power supply source, interrupt power supply from the battery to the heater and perform heating of the heater by power supplied from the external power supply source.

10. The aerosol generating device of claim 9, wherein the controller is further configured to, based on the monitored heating state being the rapid heating state, interrupt power supply from the external power supply source to the battery.

11. The aerosol generating device of claim 9, wherein the controller is further configured to, based on the monitored heating state being not the rapid heating state, control the power supply to the battery such that the external power supply source supplies power to the heater and the battery.

12. A method of operation of an aerosol generating device, the method comprising:

monitoring a heating state of a heater when the aerosol generating device is electrically connected to an external power supply source;

heating the heater without charging a battery by the external power supply source based on the monitored heating state being a rapid heating state; and charging the battery and heating the heater simultaneously by the external power supply source based on the monitored heating state being not the rapid heating state.

13. The method of claim 12, wherein the rapid heating state is a heating state in a preheating section in which temperature of the heater increases to a target temperature.

14. The method of claim 12, wherein the rapid heating state is a heating state in which the heater is supplied with power higher than or equal to reference power.

15. The method of claim 12, wherein the rapid heating state is a heating state in which the heater is supplied with a current higher than or equal to a reference current.

* * * * *